United States Patent [19]

Yoder

[11] Patent Number: 5,065,560

[45] Date of Patent: Nov. 19, 1991

[54] CONCRETE BLOCK INSPECTION FORMS

[76] Inventor: Eli J. Yoder, 7500 Richardson Rd., Sarasota, Fla. 34240

[21] Appl. No.: 623,056

[22] Filed: Dec. 6, 1990

[51] Int. Cl.[5] ..... E04B 5/46; E04B 5/08

[52] U.S. Cl. ..... 52/306; 52/599; 52/606; 52/421

[58] Field of Search ..... 52/306, 307, 308, 598, 52/599, 607, 606, 98, 421, 100

[56] References Cited

U.S. PATENT DOCUMENTS

| | | | |
|---|---|---|---|
| 1,809,385 | 6/1931 | Liptak . | |
| 2,115,264 | 4/1938 | Henderson . | |
| 2,272,061 | 2/1942 | Drake | 52/306 |
| 3,015,408 | 1/1962 | Campbell et al. . | |
| 3,123,244 | 3/1964 | Amundson . | |
| 3,330,079 | 7/1967 | Mitchell et al. . | |
| 3,674,913 | 7/1972 | Yates . | |
| 4,145,861 | 3/1979 | Yarnick . | |
| 4,729,540 | 3/1988 | Rozema | 249/192 |

FOREIGN PATENT DOCUMENTS

| | | | |
|---|---|---|---|
| 218926 | 11/1910 | Fed. Rep. of Germany | 52/421 |
| 848388 | 12/1952 | Fed. Rep. of Germany | 52/306 |
| 1057765 | 6/1953 | France | 52/98 |
| 1093587 | 2/1954 | France | 52/100 |
| 2444131 | 8/1980 | France | 52/307 |
| 404065 | 9/1943 | Italy | 52/306 |
| 624985 | 5/1961 | Italy | 52/306 |
| 275110 | 1/1952 | Switzerland | 52/98 |

OTHER PUBLICATIONS

Flyer "Hughes Manufacturing, Inc. ®1990".

*Primary Examiner*—Richard E. Chilcot, Jr.
*Assistant Examiner*—Robert Canfield
*Attorney, Agent, or Firm*—Dowell & Dowell

[57] ABSTRACT

Forms for covering inspection holes or openings in concrete block wall construction in which the forms are of a size to seal the openings and are installed within such openings interiorly of the front face of the concrete blocks. In the preferred embodiments the forms are transparent to provide visual inspection of steel reinforcement and concrete or grout filling of the cores of the concrete blocks.

26 Claims, 7 Drawing Sheets

CONCRETE BLOCK INSPECTION FORMS

BACKGROUND OF THE INVENTION

1. Field of the Invention

This invention is generally directed to methods and devices utilized in the construction of reinforced concrete block walls and more specifically to barriers or forms for closing inspection openings created in concrete blocks for the purposes of permitting visual inspection of reinforcing rods extending through the block walls. In the preferred embodiments, the forms are constructed of transparent plastic materials which are shaped so as to be seated within inspection openings formed in the concrete blocks and which are installed so as to be recessed within the openings. The forms or inspection windows include flanges or clips which are seated against the inner face of the core or cells of concrete blocks as the cells of the blocks are filled with cementitious material following the erection of a wall structure. In some embodiments the forms include two or more components which are relatively adjustable with respect to one another so that the size, i.e. height and/or width, of the forms may be selectively varied.

2. History of the Related Art

In many geographic locations it is required that walls formed of hollow core concrete blocks be reinforced with steel rods which function to anchor the walls to the concrete foundation or footings. In those areas where structures are subjected to environmental conditions such as hurricanes or tornadoes, it is necessary to ensure that the wall components of a building ar suitably anchored to the footings of the structure to prevent destruction of the walls in the case of inclement weather. The reinforcing rods are normally buried within the concrete footings and extend vertically upward for a distance of two to three feet. The reinforcing rods are generally spaced at various distances which are established by local codes. By way of example, in some areas such reinforcing rods are required at intervals of either eight or sixteen feet and at each corner of a wall structure, depending upon the height of the wall and the end use for which the structure is being built.

During the initial phases of concrete wall construction at each point at which a hollow concrete block is seated over a reinforcing rod an inspection hole or window is created in the face of the block so as to permit building inspectors to determine that proper tying of steel reinforcing rods is accomplished before the wall is completed. As each course of concrete blocks is laid the cells of the blocks are aligned vertically above each of the reinforcing dowel rods extending upwardly from the foundation. After the required number of courses of concrete blocks have been laid, reinforcing steel rods are extended vertically through the aligned cells above each of the reinforcing bars extending from the foundation with the end portions of the bars being joined utilizing metallic ties. The uppermost portion of the wall reinforcing bars are thereafter united to horizontally oriented reinforcing bars which extend along the upper lintel block course. In this manner the blocks are connected both horizontally and vertically to the floor or foundation.

After the proper tying of the vertically oriented steel rods to the foundation steel rods has been approved by an engineer or building inspector, the aligned cells of the concrete blocks through which the steel extends must be filled with a cementitious material such as a concrete or grout mixture. By pumping the cementitious material into the aligned cells of the concrete blocks, continuous reinforced concrete columns are formed which columns unite the steel and concrete blocks throughout the height of the masonry construction.

One of the problems associated with reinforced concrete block construction is that each of the inspection openings created in the lower course of concrete blocks must be sealed prior to the vertically aligned cells being filled with cementitious material. Traditionally, workers place a board or other barrier against the front face of the block wall and thereafter utilize different reinforcing techniques to apply pressure to the barrier from the outside to seal the openings. Frequently, due to the amount of pressure on the barriers utilized to seal the inspection openings, the boards or other barriers will be forced outwardly from the face of the wall as the cementitious material is being poured. In worst instances, the barriers will fail thereby allowing cementitious material to pour out the openings in the blocks and thus requiring additional time and labor to be expended to remove the material which has "blown out" through the openings. Thereafter new forms must be installed to seal the openings and additional cementitious material pumped into the vertically aligned cells. This problem is complicated in corner areas where the openings are frequently formed along two sides of a block thereby requiring that two forms be applied to the surface of the block to retain cementitious material therein during the cell filling process.

Even in those instances where the forms for sealing the inspection openings in concrete blocks do not fail completely, the forms or barriers will frequently shift allowing some cementitious material to flow outwardly with respect to the front face of the concrete wall. In these instances, it is necessary for workers to chisel off the protruding concrete material which sets up and forms a rough surface on the face of the concrete wall in order to provide a smooth finished appearance to the wall.

In an effort to reduce failure of the barriers or forms which are utilized to seal the inspection openings in concrete blocks, one company has developed a product which utilizes hook elements which are embedded between the vertical courses of concrete blocks adjacent each edge of the inspection openings. After the wall is formed, a bar is inserted into the hooks and thereafter wedges driven between the bar and the face of the concrete blocks against boards which are placed over the inspection openings. Such a technique is time consuming and laborious. Further, once an opening has been sealed, it is necessary to remove the wedge elements, boards, and cut the metallic hooks and drive the protruding end portions thereof back into the wall. Also, utilizing such a technique, it is not possible to ensure that the cementitious material which has been pumped into a vertically aligned column of concrete block cells actually fills the entire column as the inspection opening is covered with an opaque material.

In some instances, as the cores or cells of concrete blocks are being sealed with cementitious material, air pockets may be created which prohibit or prevent the cementitious material from completely filling a column of cells, thereby creating voids which effect the integrity of the reinforced wall structure. When an inspection opening is sealed so that it is impossible to view the opening until after the cementitious material has been poured and set, there is no way to ensure that the column is completely filled until after the initially placed material sets or hardens.

Some examples of prior art construction techniques and construction blocks which utilize windows of various types are disclosed in U.S. Pat. Nos. 1,809,385 to Liptak, 2,115,264 to Henderson, 3,330,079 to Mitchell et al., and 4,145,861 to Yarnick. In addition, reference is made to applicant's co-pending patent application, filed concurrently herewith, and entitled MASONRY INSPECTION BLOCK, which is directed to structures for concrete blocks having preformed or molded inspection openings provided in the blocks for purposes of facilitating the sealing of the openings therein in a manner as taught by the present application. The contents of the co-pending application are contained herein by reference.

SUMMARY OF THE INVENTION

This invention is directed to barriers or forms for covering inspection openings required in concrete block wall construction prior to the filling of the cells of the concrete blocks with cementitious material and wherein the forms are of a size to be inserted within a cell of a concrete block and thereafter oriented so that the edges thereof will seat against the inner face or edges defining the opening through the front face of the concrete block. The forms may include one or more retention elements which extend outwardly from the front face thereof and which engage the exterior surface of a concrete block to thereby retain the forms in position until such time as cementitious material is introduced into the cell of the block.

In a first embodiment of the present invention the forms are formed as transparent plastic windows which are generally rectangular in configuration having a front face and side edges which extend rearwardly of the front face along each side and top and bottom thereof. Flanges are provided which extend outwardly from each of the side and to edges of the forms with such flanges being oriented generally parallel to but spaced from the plane of the front face thereof. The side walls and upper and lower walls are generally tapered outwardly from the front face of the windows or forms so as to allow the forms to be wedged within an opening created in a concrete block. The dimensions of the side and upper walls are such that when the flanges extending therefrom engage the inner face of a concrete block cell that the front face of the forms will be recessed slightly with respect to the front face of the concrete block. A plurality of holes are provided through the face of the forms and serve to allow air which might otherwise be trapped within a column of cells to be expelled during the introduction of a cementitious material and further permit minor amounts of cementitious material to seep through the front face of the barriers or forms.

The retention elements may include a continuous wire which extends through the holes and outwardly with respect to the front face of the forms with the outer end portions thereof being engagable with the exterior surface of a concrete block adjacent either side of the inspection opening therein.

In the preferred embodiments, the transparent forms are constructed of two or more components which are in overlapping relationship and relatively adjustable with respect to one another. Each form includes a front panel and a rear panel with the front panel incorporating a rotatable cam mechanism which is engagable with an abutment member carried by the rear panel so that as the cam mechanism is rotated the rear panel will be extended either horizontally outwardly and/or vertically upwardly. In this embodiment, the forms may be adjusted to be cooperatively seated within block openings of various sizes.

In a further embodiment, the forms include a front panel having a plurality of inclined openings or holes therethrough. A plurality of relatively yieldable hook or clip members extend rearwardly from the periphery of the front panel so as to frictionally engage the inner surface of a cell of a concrete block.

With the present invention, an inspection opening in a concrete block wall is sealed with the use of a transparent barrier or form which is inserted through or into the opening into the cell of a block after which the form is urged forwardly in order to seat the form within the opening. Once an inspection has been made to ensure the proper placement, overlapping and tying of steel, the cell of the block is filled with cementitious material. The cementitious material will act to seat the form against the inner walls of the block. A small portion of the cementitious material will bleed through the holes in the forms and provide a textured surface with which a concrete grout will unite when the grout is placed over the front face of the form to thereby completely obscure the form and create a continuous surface along the face of the block.

It is the primary object of the present invention to provide forms or barriers which may be utilized to close inspection openings created in concrete blocks so as to permit the cells of the blocks to be filled with cementitious material following the inspection of the proper placement, overlapping and tying of steel dowel rods extending therethrough.

It is another object of the present invention to provide closures or forms for sealing inspection openings in concrete blocks which may be placed within the openings at any time during the construction of a concrete block wall and which are porous and/or transparent so that inspections may be made at any time and so that workers can ensure that cementitious material completely fills the open cells of the blocks during the pouring of cementitious materials.

It is also an object of the present invention to provide forms or barriers for use in sealing inspection openings in concrete blocks wherein the forms have outward extending flanges or clips which abut the inner face of the cores or cells of the blocks so that as cementitious material is introduced therein the cementitious material will effectively push or urge the windows into sealed engagement with the blocks adjacent the openings created therein.

It is another object of the present invention to provide transparent inspection windows for use as forms to seal openings in concrete construction blocks which windows include a plurality of holes therethrough which permit air to escape from columns of concrete block cells to thereby reduce the chance of an incomplete filling of the columns with cementitious material and wherein the cementitious material may also seep through the holes to thereby provide a roughened surface upon setting to which an outer grout layer may be applied so as to seal off the inspection windows from the front surface of concrete blocks.

A further object of the present invention is to provide forms for sealing openings in concrete blocks wherein the forms are adjusted horizontally and/or vertically so that they are adapted to fit openings of various sizes.

It is yet another object of the present invention to provide a method for sealing inspection openings in concrete block wall construction wherein visual inspection is facilitated, labor for creating the inspection opening and closing of the inspection opening reduced, and wherein failure of a barrier or form effectively prevented to thereby reduce down time caused by "blow out" failure of a closure.

It is also an object of the present invention to provide a method for finishing or sealing inspection openings provided in masonry wall construction which alleviates the work conventionally necessary to seal such openings and which is fail-safe thereby effectively reducing construction costs by reducing labor and material costs.

DESCRIPTION OF THE PREFERRED EMBODIMENT

Figure 1:
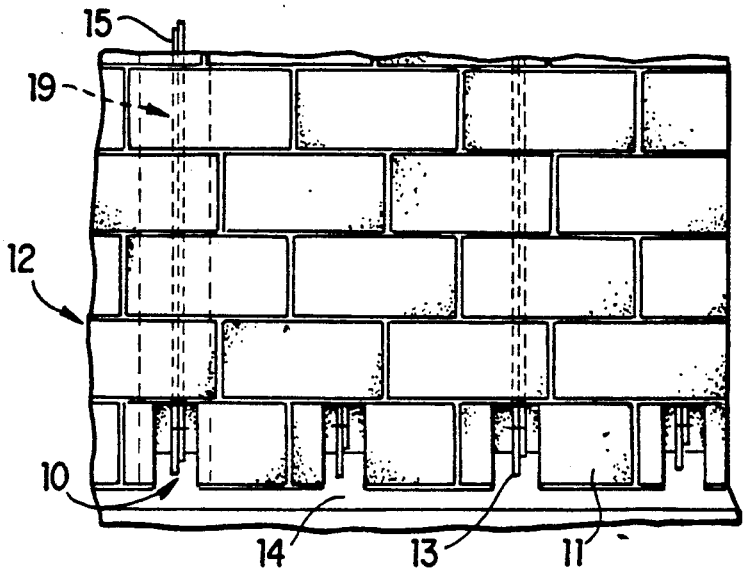
FIG. 1 is a partial illustrational view showing a portion of a concrete wall having a plurality of inspection windows created along the base course of concrete blocks and showing the steel reinforcing rods extending from the foundation adjacent to the vertical reinforcing rods associated with the wall structure and which extend upwardly through an aligned column of open cells.
Figure 2:
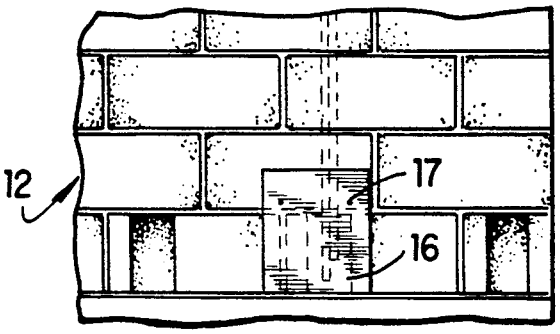
FIG. 2 PRIOR ART
FIG. 2 is an illustrational view of a conventional form for sealing an inspection opening prior to the filling of the concrete block cells with cementitious material.
Figure 3:
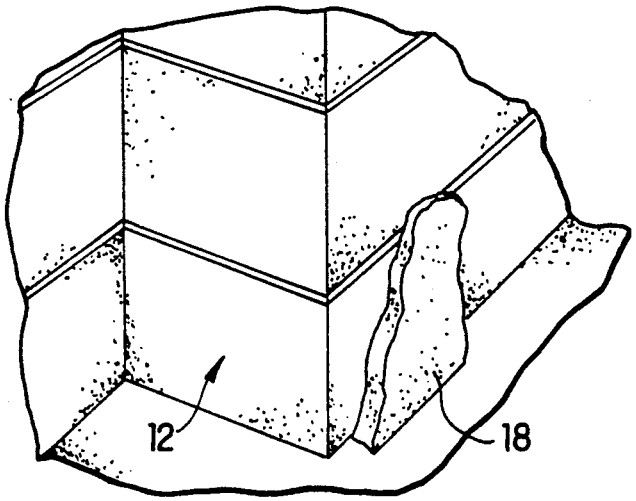
FIG. 3 PRIOR ART
FIG. 3 is an illustrational view of a conventional blow out showing the cementitious material as it has set up after urging the form shown in FIG. 2 away from the face of the concrete wall.

With reference to FIGS. 1-3 of the drawings, the environment of the present invention is set out in greater detail. The invention is designed for use in sealing inspection openings 10 which are created in a base course of concrete blocks 11 used in the construction of a concrete wall 12. The inspection openings are provided at each corner of the construction as well as at spaced intervals along the length of the concrete block wall as mandated by local building codes. The inspection openings 10 permit site inspectors to ensure that the steel reinforcing rods 13 which are embedded within the foundation 14 are properly tied to vertically oriented reinforcing rods 15 which extend the full height of the wall. Each vertical reinforcing bar extends through an aligned column 19 of block cells which, after the steel has been placed and tied, will be filled with a cementitious material. Prior to the filling of the column 19 with cementitious material it is necessary to seal the inspection openings to prevent the escape of the cementitious material as it sets up within the column.

As shown in FIG. 2, a conventional method of covering an inspection opening 10 is by placing a board 16 against the front face of the concrete blocks covering the opening and thereafter nailing the board to the concrete blocks such as shown at 17. Alternatively, the board may be reinforced by a wedge structure, not shown. In either instance, frequently the pressure of the cementitious material within the wall will cause the covering board to move outwardly with respect to the wall, either creating a complete failure in which case cementitious material would freely flow through the opening or creating a partial blow out in which case the cementitious material would set up forming an irregular surface 18 along the front face of the wall which would have to be removed prior to complete finishing of the wall structure, as is shown in FIG. 3.

With particular reference to FIGS. 4-9 of the drawings, a first embodiment of the present invention is disclosed for sealing inspection openings in concrete construction blocks utilizing barrier inserts or forms 20 which are specifically designed to seal the openings not from the front face, as with conventional barriers, but by being seated against the inner face of the core of a concrete block. In the drawing figures the form 20 is shown as being a transparent plastic window which includes a front panel 21 which is generally rectangular in configuration. The overall configuration of the front panel, however, may change and may be oval, square, circular, or otherwise depending upon the exact nature of the opening being sealed.

Figure 4:
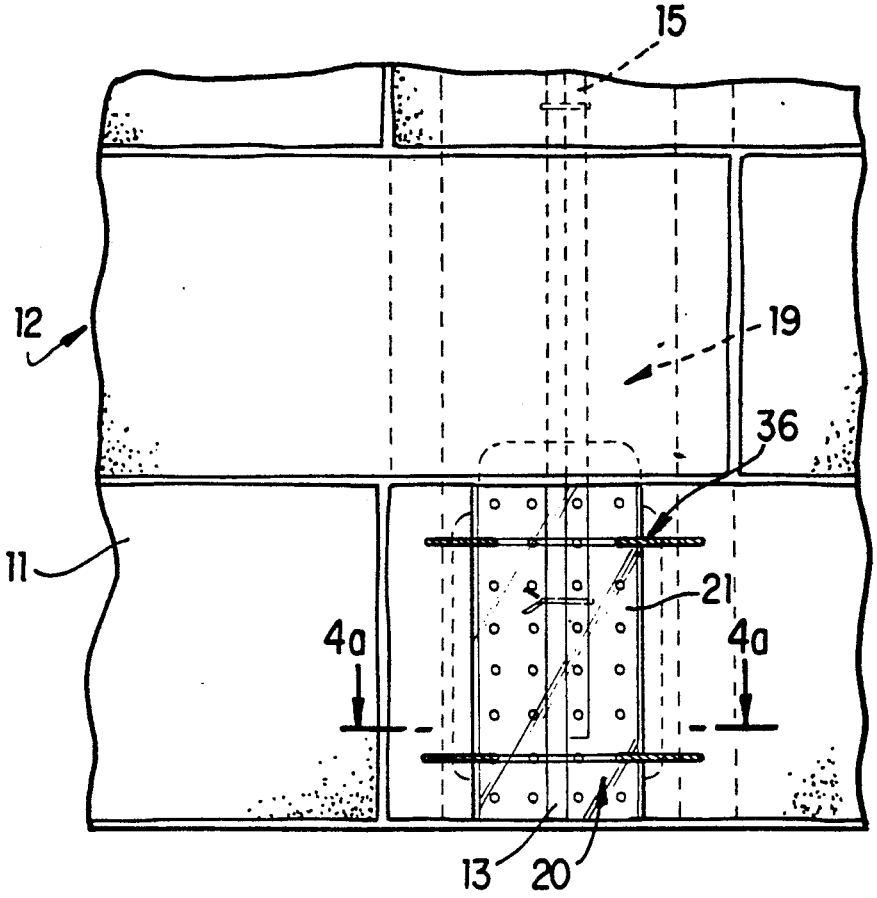
FIG. 4 is an illustrational view of an embodiment of the present invention as it is shown installed within an inspection opening created in a concrete block and showing the tying of the steel dowel rods prior to the filling of the core or cell with cementitious material.
Figure 4A:
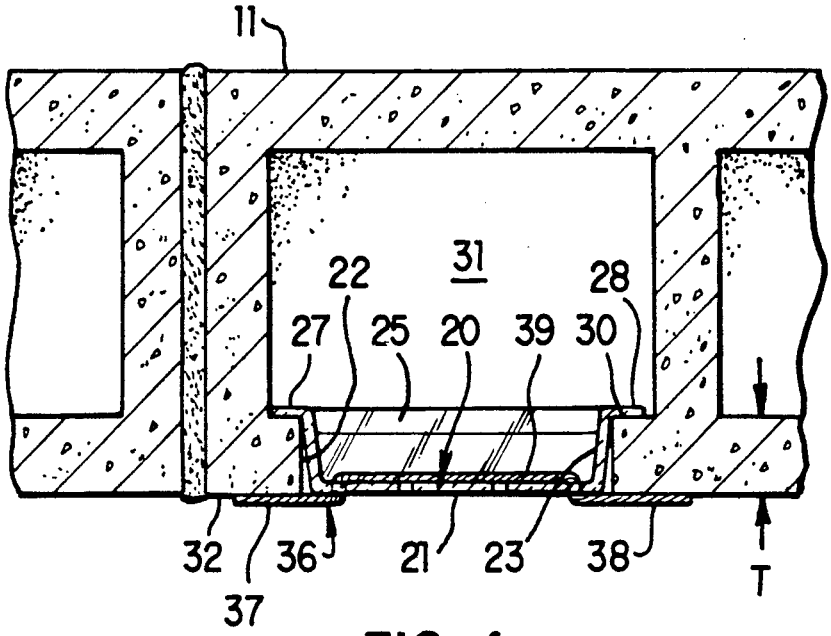
FIG. 4A is a cross-sectional view taken along line 4A—4A of FIG. 4.
Figure 5:
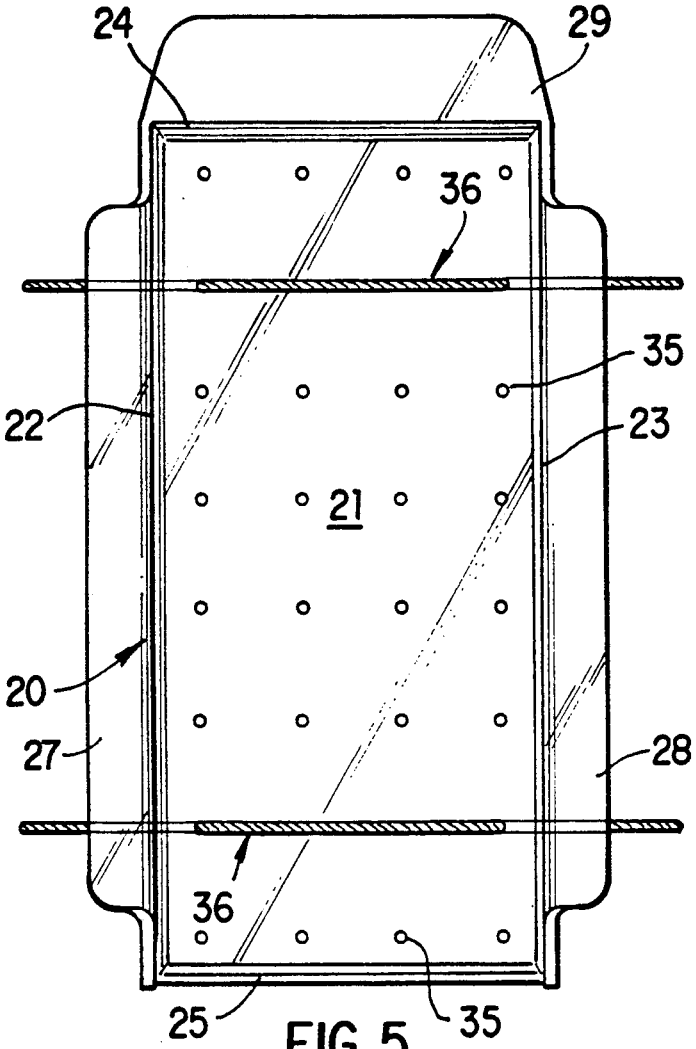
FIG. 5 is a front plan view of the window form of FIG. 4.
Figure 6:
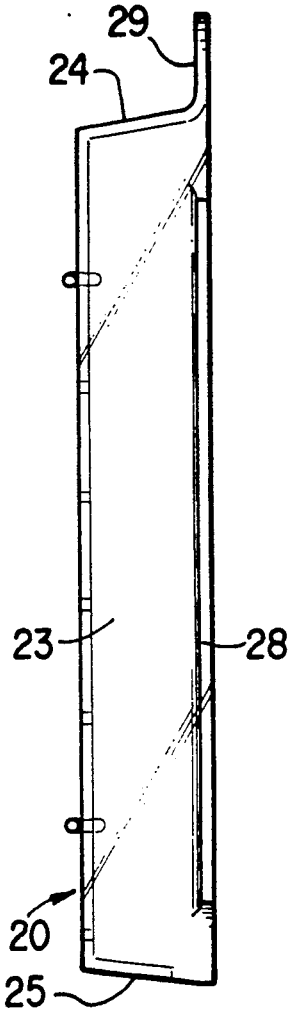
FIG. 6 is a left side view of the window form of FIG. 5.
Figure 7:
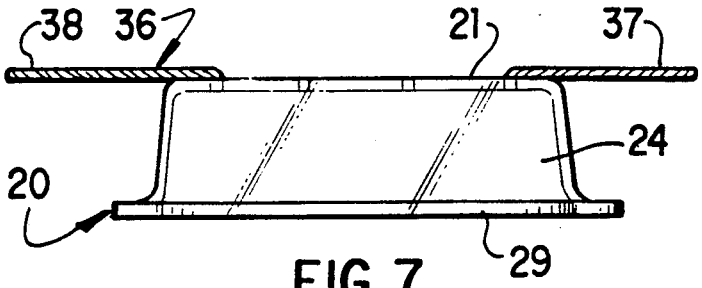
FIG. 7 is a top plan view of the window form of FIG. 5.
Figure 8:
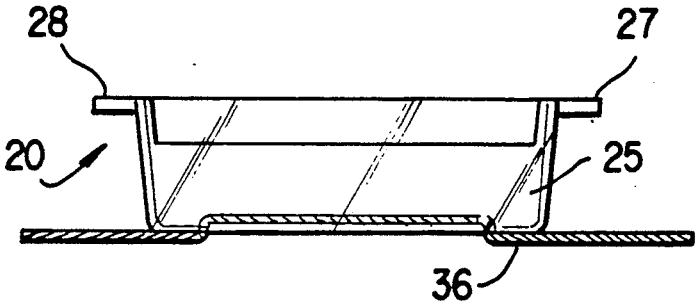
FIG. 8 is a bottom plan view of the window form of FIG. 5.

The form or inspection window of FIGS. 4-9 includes side walls 22 and 23 which extend rearwardly with respect to the front panel 21 and taper outwardly with respect thereto, as shown in FIGS. 7 and 8. The barrier window further includes an inwardly extending top wall 24 and bottom wall 25, again which taper or flare outwardly such as shown in FIG. 6. A pair of elongated flanges 27 and 28 extend outwardly from each of the side walls 22 and 23, respectively. The elongated flanges are generally parallel with the front face or panel 21 of the inspection window as is shown in FIGS. 7 and 8. A top flange 29 extends outwardly from top wall 24 and is also parallel to the front face or panel 21 of the barrier window. The spacing between the side and top flanges and the front face of the form or inspection window is slightly less than the thickness T of the wall of a conventional concrete block so that when the barrier window is placed within an opening 10 the flanges 27, 28, and 29 will engage the inner face 30 of the cell or core 31 of the concrete block with the front face or panel 21 being recessed from the front face 32 of the concrete block for purposes of which will be discussed in greater detail hereinafter.

In the preferred embodiment a plurality of air holes 35 are provided in spaced relationship through the front panel or face of the form or window with such openings generally not exceeding approximately an eighth of an inch in diameter.

In order to retain the form or inspection window within the opening 10 of a concrete block, retention wires 36 are provided which extend outwardly adjacent the upper and lower portions of each window. As shown in FIG. 5, the wires have outer portions 37 and 38 which extend outwardly relative to the front face 21 and an inner portion 39 which extends along the rear portion of the front face as shown in dotted line. The wires are supported through aligned openings 35. It is preferred that the wires be sufficiently rigid to secure an inspection window or form in place after the form has been inserted within an opening 10 by the outer end portions thereof engaging the front face 32 of the concrete block adjacent the opening as is shown in FIG. 4. Preferably the wire is a sixteen gauge aluminum wire however other wires or retention elements may be utilized. In addition, in some instances, a single wire may be sufficient whereas in other instances more than two wires may be required.

Figure 9:
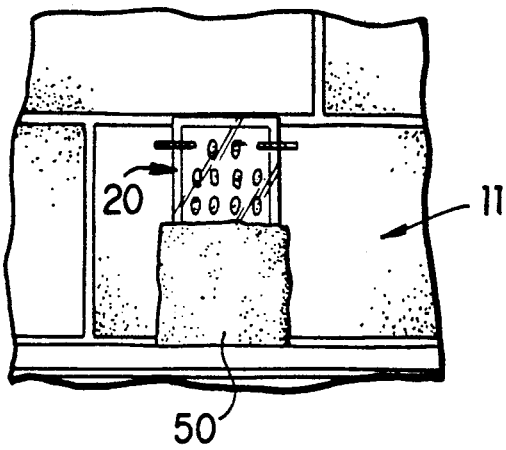
FIG. 9 is an illustrational view showing the relationship between the front face of the window form relative to the front face of a block and showing cementitious material extending through the openings therein and also showing the effect of finishing the face of the concrete block by the application of mortar after the cementitious material within the cell of the block has set.

As shown in FIGS. 4 and 9, it is preferred that the height of the form or window 20, with respect to the block, is generally the height of the block so that the front face 21 thereof substantially fills the entire opening 10. If the block is formed so that the opening 10' is defined by side walls which extend the full height of the block then the concrete block may be laid either right side up or upside down without effecting the use of an inspection window to close the opening therein.

With continued reference to FIGS. 4 and 9, after the steel reinforcing rods 13 and 15 have been tied together the form or inspection window 20 is inserted within the core 31 of the block and thereafter pulled toward the opening so that the front panel 21 is seated within the opening 10 or 10'. In this position the flanges 27, 28, and 29 associated therewith will abut the inner surface of the block and form seals which will be urged into tighter engagement with the inner face of the block upon the introduction of a cementitious material within the cells or cores of the block. To retain the inspection windows in place the retention wires 36 are bent outwardly thereby supporting the inspection windows until such time as the cementitious material is applied within the core or cell. During the pouring of a cementitious material any air which may otherwise be trapped within a column of vertically aligned cells will escape through the air holes in the inspection window. Further workmen can view the inspection window to ensure that cementitious material has completely filled the bottom portion of the column. The air hole openings will also function to permit a small portion of the cementitious material to seep therethrough. After the cementitious material hardens a rough textured surface will be provided along the front of the panel 21 which will serve to anchor a grout material 50 which is thereafter applied by trowelling the cement or grout across the front face 21 and effectively sealing off the window and creating a smooth continuous wall.

Although the form or inspection window 20 of the present invention has been described as being transparent it should be noted that in many instances it may be possible to use wood or other translucent or opaque materials, however such materials would not have the added benefit of allowing visual inspection of the cells of the blocks during the pouring of the cementitious material and would also require that the barriers be placed only after an inspector had made the proper inspection of the placement, alignment and tying of the steel reinforcing rods within the concrete wall.

Figure 14:
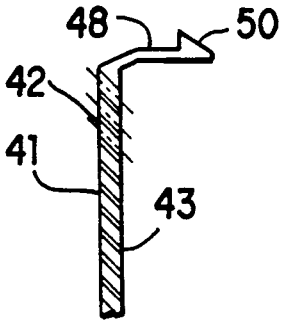
FIG. 14 is an enlarged partial cross-sectional view taken along line 14—14 of FIG. 11.

With specific reference to FIGS. 11-14, a second embodiment of the present invention is shown in greater detail. In this embodiment, the window form 40 includes a front transparent panel 41 having a plurality of closely aligned holes 42 disposed therethrough. The holes are disclosed as being somewhat hexagonally configured and are of an approximate diameter not exceeding ⅛". Unlike the embodiment disclosed in FIGS. 4-10, in this embodiment the holes 42 are shown as being closely spaced with respect to one another. In addition, as shown in FIG. 14, the holes are tapered downwardly from the front panel 41 to the rear surface 43 thereof. The tapered holes will permit air to escape and will also allow a limited amount of cementitious material to flow therethrough when cementitious material is poured within the core of a concrete block to which the form is secured.

The window form 40 also includes upper and lower edges 44 and 45 and side walls 46 and 47. Unlike the embodiment disclosed in FIGS. 4-9, which included wire retention elements to secure the forms in place within an opening in a concrete block, in this embodiment, a plurality of integrally formed plastic clips 48 and 49 extend outwardly from the upper edge 44 and side edges 46 and 47 of the form. Each of the clips 48 and 49 has an outermost hooked end portion 50 and 51, respectively, which are designed to engage or contact the inner face of the core of a block or a portion of a side wall defining the opening through the block. Further due to the elongated structure of each of the clips, the clips will yield relative to the front panel 41 upon insertion of the window form and thereafter will snap outwardly s that the hooked end portions thereof will be secured to the concrete block to which the form is attached. In some instances, only the elongated clips 48 will be associated with the forms. The clips 48 are of a length to cause the hooked end portions 50 thereof to engage the inner surface of a core of a concrete block in which the form is inserted. However, in other instances and as will be discussed in greater detail hereinafter, the shorter clips will provide added retention force as the shorter hooks will cooperate with specially formed side walls in concrete blocks having preformed openings therein. The preformed openings will be described with respect to a combination of a preformed block and an inspection window form as set forth in drawing FIG. 10. As with the embodiment of window form disclosed in FIGS. 4–9, in this embodiment the height of the window form 40 should be equal to the height of the opening 10 formed in a concrete block.

Figure 15:
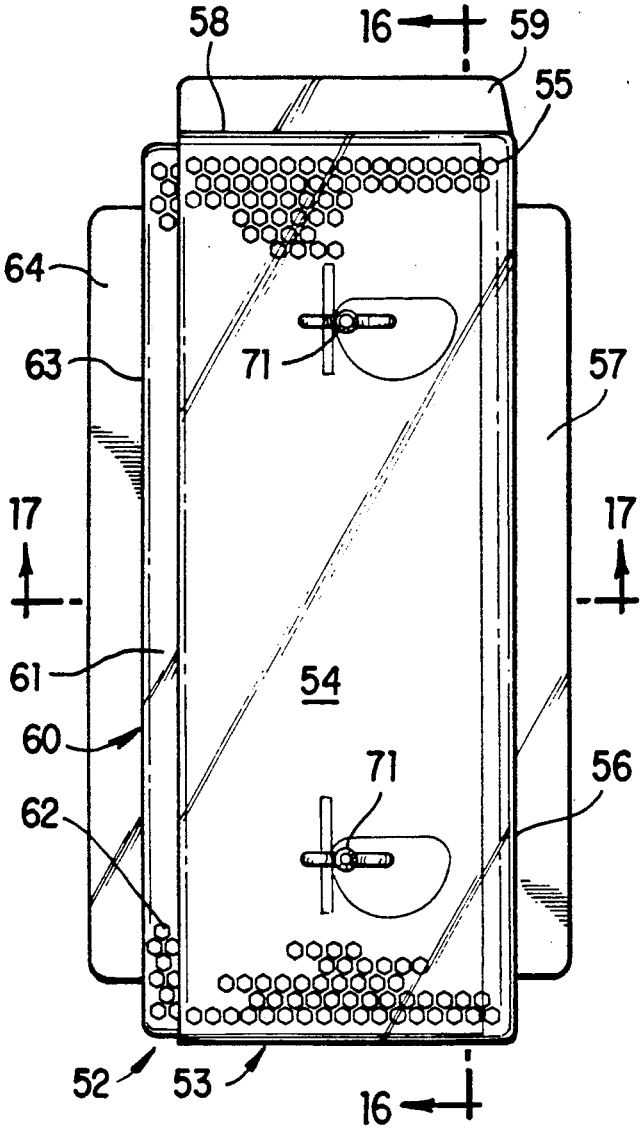
FIG. 15 is a front plan view of a preferred embodiment of the present invention.
Figure 16:
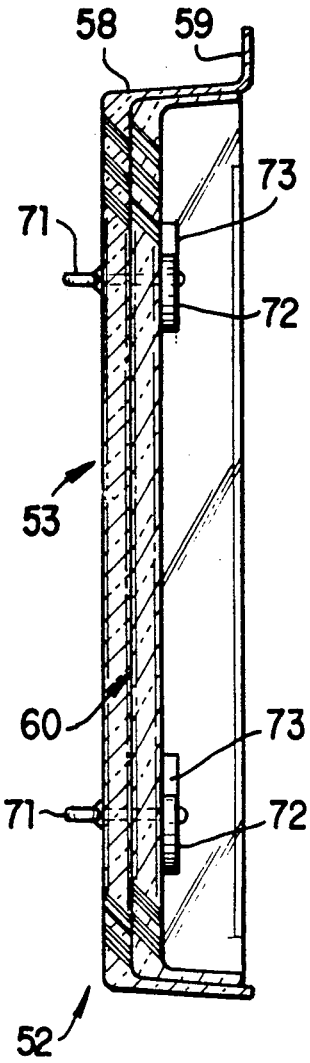
FIG. 16 is a cross-sectional view taken along line 16—16 of FIG. 15.
Figure 17:
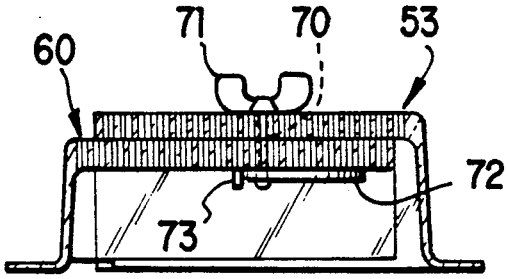
FIG. 17 is a cross-sectional view taken along line 17—17 of FIG. 15.

A preferred embodiment of the present invention is disclosed in FIGS. 15–17. In this embodiment, the overall configuration of the forms 52 is similar to the embodiment of the invention shown in FIGS. 4–9. However, in this embodiment the forms are designed to be horizontally extensible so that they may be adjusted when placed within an opening such as 10 in a concrete block. In this respect, the forms 52 have an outer transparent section 53 having a front face 54 through which a plurality of holes 55 are provided in a manner similar to that of the embodiment disclosed in FIG. 11 so that the holes 55 taper downwardly from the front to the rear of the panel 54. The outer section 53 further includes a side wall 56 which extends generally perpendicularly from the front panel 54 and which terminates in an outwardly extending flange 57 which is generally parallel with the front panel. The outer section further includes an upper wall 58 which extends generally perpendicularly with respect to the front panel 54 and which terminates in an outwardly extending flange 59 which is generally parallel with the front panel. Selectively mounted to the front section is a rear section 60 which includes a front panel 61 having a plurality of holes therein which are designed to generally align with the holes 54 in the front section. The rear section 60 further includes a side wall 63 which extends generally perpendicularly from panel 61 and which terminates in an elongated flange 64 which is oriented generally parallel with the front panel. As in the embodiment disclosed in FIGS. 4–9, in this embodiment the side walls of each section, as designated at 56 and 63, are of a depth to permit the flanges 57, 59 and 64 to be brought into abutting relationship with the inner face 30 of the core of a concrete block when the form 52 has been inserted through an opening 10 in the block with the front panel 54 recessed with respect to the front face of the block.

In order to allow the form 52 to be expanded horizontally to adjust the size of the form to fit various widths of openings 10 in concrete blocks the rear section 60 is interfitted with the front section 53 by way of pins 70 which extend through aligned openings created in each of the form sections. Each pin 70 is secured on their outer end to a wing nut 71 which is oriented outwardly of the front panel 54 and along their inner end to a cam member 72 which extends generally parallel with the rear surface of the front panel 61 of form section 60. Although two such pin members 70 are shown in the drawing figures, it is possible that a single or a plurality of such mechanisms, including the wing nut and cam member, may be utilized to interfit the two sections. The adjusting member defined by the pins 70, wing nuts 71 and cams 72 are designed to permit a relative shifting of the form sections 53 and 60 upon the rotation of the wing nuts 71. In this respect, abutment walls 73 are integrally formed and extend from the inner surface of the front panel 61 of the rear section 52, as is shown in FIG. 17. The abutment walls 73 are selectively engaged by the cams 72 so that as wing nuts 71 are rotated the cams 72 will be urged against the abutment walls 73 thereby progressively urging section 60 outwardly with respect to cam section 53. Again, where two adjusting mechanisms are provided, two abutment walls 73 are also provided for selective engagement by the cams 72. With the embodiment of the invention shown in FIGS. 15–17 not only will the adjusting mechanisms permit a selective size adjustment to be made with respect to the horizontal spacing possible between the sections 53 and 60 but the pressure of the cam mechanisms 72 against the abutment walls 73 will further secure the side walls 56 and 63 of the upper and lower sections, respectively, against the inner edges of the openings provided in concrete blocks.

Figure 18:
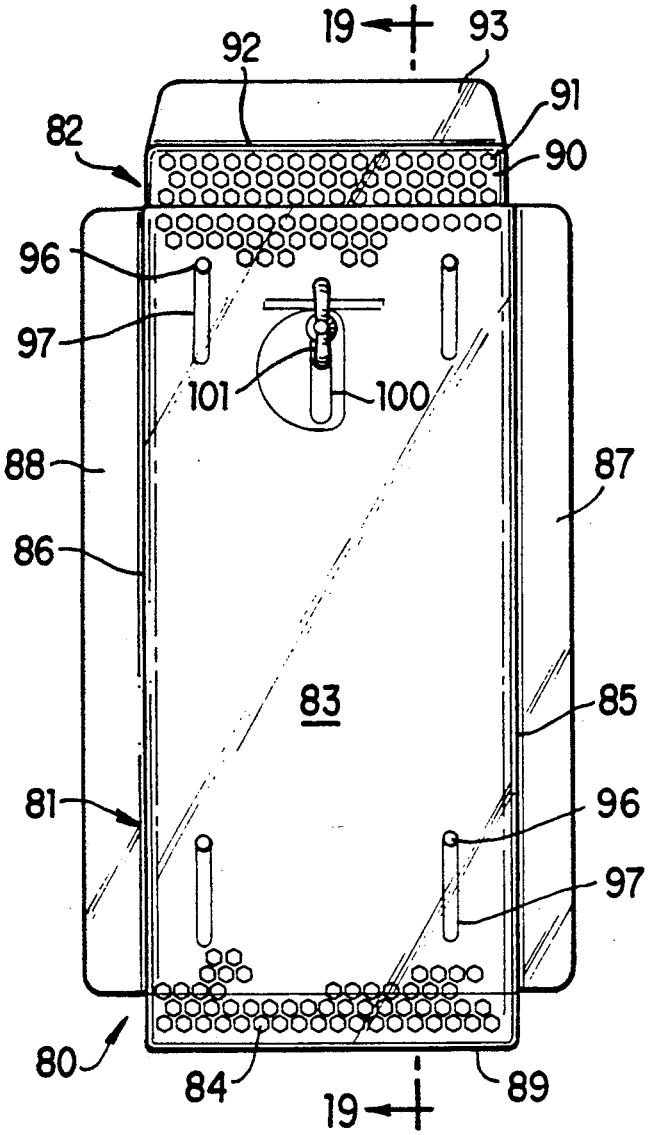
FIG. 18 is a front plan view of yet another embodiment of the present invention.
Figure 19:
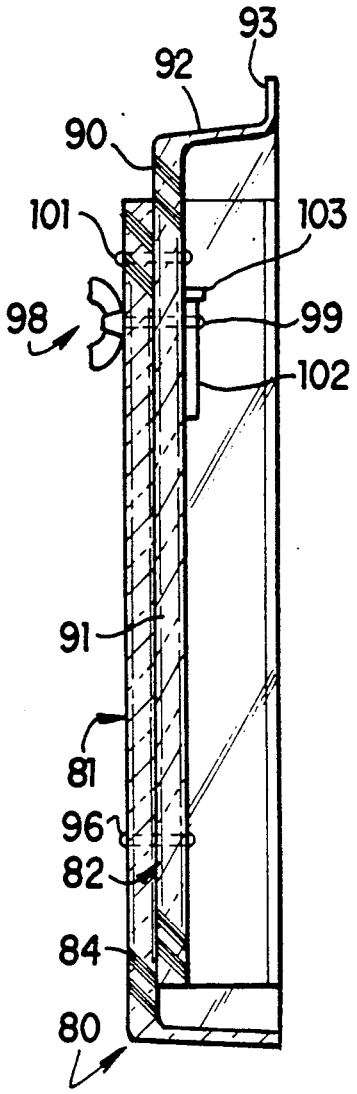
FIG. 19 is a cross-sectional view taken along line 19—19 of FIG. 18.
Figure 20:
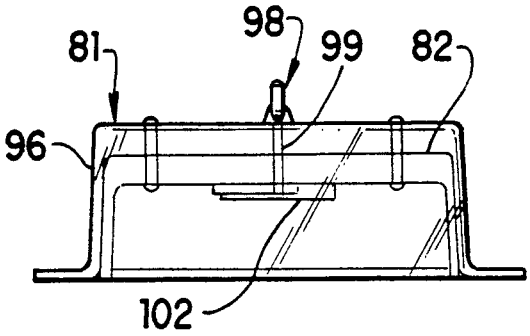
FIG. 20 is a bottom plan view of the window form of FIG. 18.

With specific reference to FIGS. 18–20, a modification of the embodiment shown in FIGS. 15–17 is disclosed wherein the forms 80 include an upper section 81 and lower section 82. The upper section includes a front panel 83 having a plurality of holes 84 therein which are tapered downwardly from the front face to the rear face of the panel 83 as is disclosed with respect to the embodiment of the invention shown in FIGS. 15–17. The upper section 81 further includes a pair of spaced side walls 85 and 86 which extend generally perpendicularly therefrom and which are of a depth which generally equals the thickness of the side walls defining an opening 10 made in a concrete block. Each of the side walls 85 and 86 terminate in outwardly extending elongated flanges 87 and 88 which seat against the inner surface 30 of a cell of a concrete block in a manner as described with respect to the embodiment of FIGS. 4–9. The outer section 81 further includes a lower wall 89 which may be tapered slightly as was disclosed with respect to the embodiment of FIGS. 4–9. In this respect, side walls 85 and 86 may likewise be tapered outwardly slightly as was disclosed with respect to the embodiment of FIGS. 4–9.

In the embodiment shown in FIGS. 18–20, the rear section 82 is shown as being slidably engaged against the rear portion of the front panel 83 of the front section 81. The rear section 82 includes a front panel 90 having a plurality of holes 91 therethrough which are of a size and configuration and orientation to match that of the holes 84 through the front section 81. The rear section 82 further includes an upper wall 92 which extends generally perpendicularly therefrom and which may be tapered slightly, as is shown in FIG. 19, in a direction upwardly with respect to the front panel 90. The upper wall 92 terminates in an outwardly extending flange 93 which is generally parallel with the panel 90. The rear section further includes a pair of elongated side walls 94 and 95 which extend along the inner surface of each of the side walls 85 and 86 of the front section.

In the embodiment shown in FIGS. 18–20, the rear section is designed to be vertically extended with respect to the front section. In this respect, the two sections are interconnected by a plurality of pin members 96 which extend rearwardly from the front section 81 and which are aligned to ride through slots 97 formed in the front panel 90 of the rear section 82. The length of the slots 97 will determine the limitation of vertical adjustment of the rear section 82 with respect to the front section 81. The rear section is moved by an adjusting mechanism 98 which is similar to that disclosed in the embodiment of FIGS. 15–17. The adjusting mechanism includes an elongated pin or shaft 99 which extends through both sections and through an elongated slot 100 provided in the rear section 82. The shaft 99 is connected at its outer end to wing nut 101 and at its inner end to a cam 102. The cam is designed to be engagable with an abutment wall 103 which extends from the rear of the panel 90 of the rear section 82. In this manner, as the wing nut 101 is rotated the cam 102 will engage the abutment wall 103 and thereby force the rear section 82 upwardly with respect to the front section 81 until such time as the rear section is extended to fully fill an opening, such as 10, provided in a concrete block.

As with the embodiment of FIGS. 4-9, the embodiment of the invention shown in drawing FIGS. 11-20 are also primarily designed for use with transparent plastic materials. However, in some instances other materials even opaque or translucent materials may be utilized, however, such materials have the disadvantage of not allowing a visual inspection to be made through the forms after they have been installed.

Figure 10:
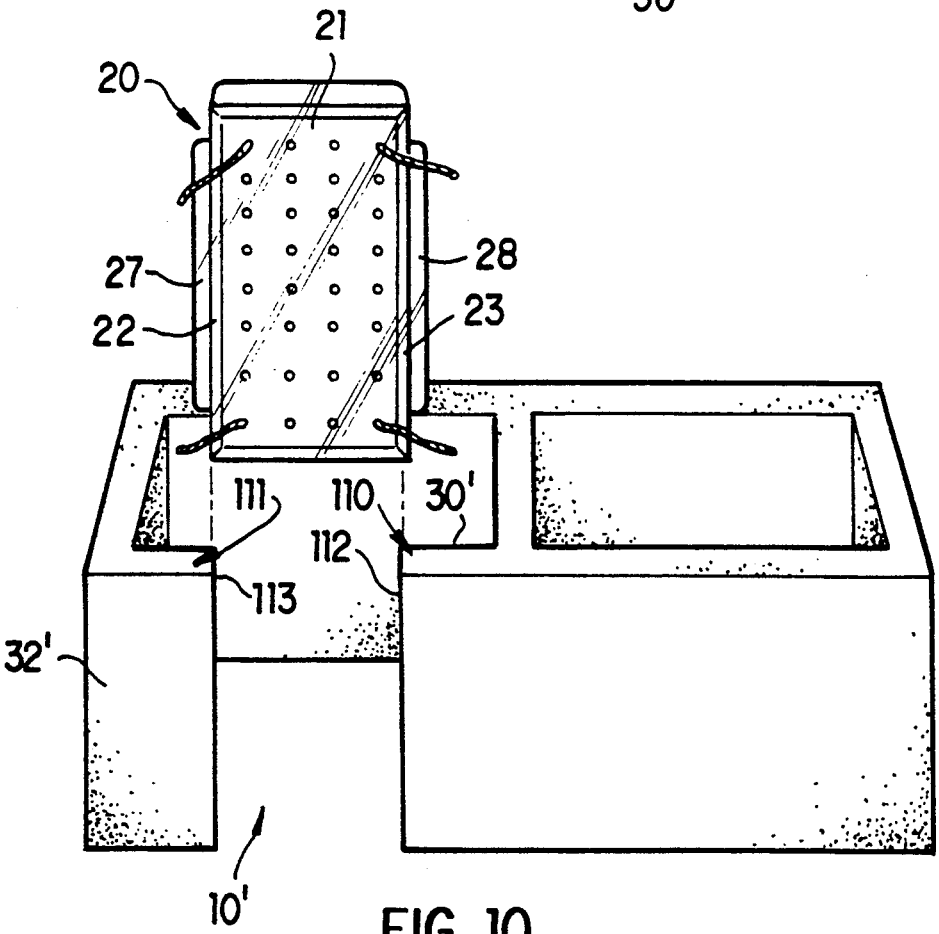
FIG. 10 is a perspective illustrational view showing, in combination, the inspection window form of FIG. 5 and a preformed inspection block.
Figure 11:
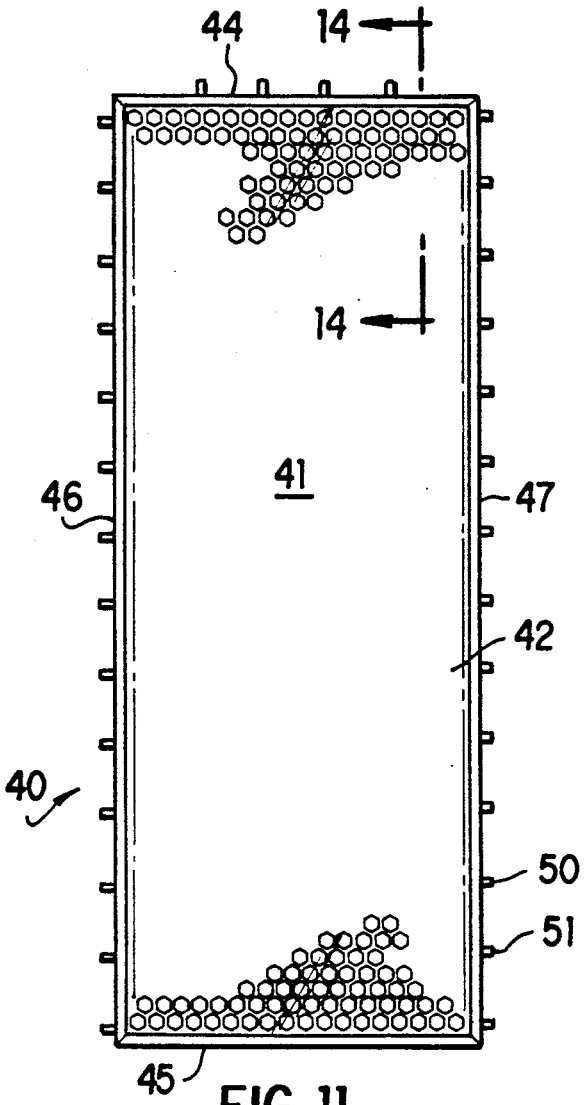
FIG. 11 is a front plan view of another embodiment of window forms in accordance with the present invention.
Figure 12:
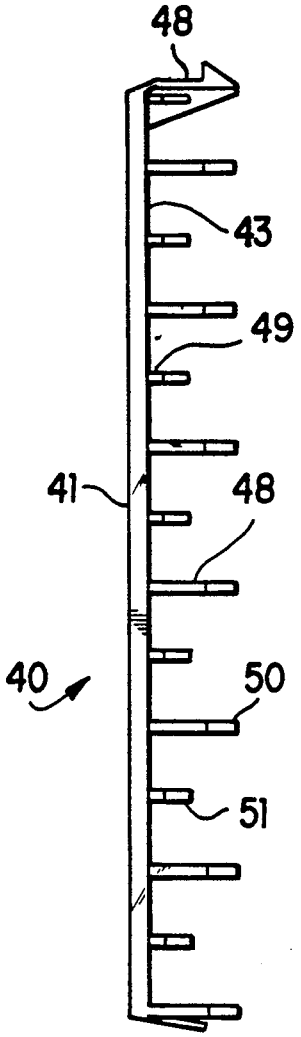
FIG. 12 is a left side view of the window form of FIG. 11.
Figure 13:
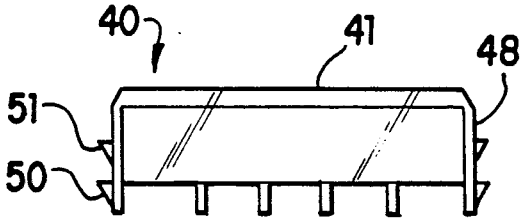
FIG. 13 is top plan view of the window form of FIG. 11.

With reference to FIG. 10, the various embodiments of the present invention, such as the form shown at 20, are designed to be cooperatively seated with an opening 10' which is preformed in a concrete block. The opening 10' includes generally V-shaped side edges 110 and 111 which are tapered outwardly from the inner face 30' of the block to the outer face 32' of the block and thereby form tapered seats against which the side walls 22 and 23 of the forms will be cooperatively wedged when the forms are installed relative to the opening 10'. Further, the side walls defining the opening 10' may include a pair of opposing flanges 112 and 113 which will serve to abut the front face 21 of the forms when the forms are in place thereby further securely seating the forms with respect to an opening 10'.

As previously discussed with respect to the embodiment of the invention disclosed in FIGS. 11-14, the form 40 is designed to be secured in place by locking the integrally formed clip members 48 and 49 within an opening such as 10', shown in FIG. 10. In this respect, the shorter clips 49 are designed to be seated within the V-shaped side edges 110 and 111 defining the opening through the side wall of the block with the hooked end portions 51 thereof seated against the flanges 112 and 113. Therefore, the form 40 is locked not only to the front flanges 112 and 113 associated with the formed opening in a concrete construction block but the elongated clips 48 will be secured to the inner face 30, of the block core.

I claim:

1. An apparatus for sealing an inspection opening formed in a concrete block which opening permits a visual inspection to be made to confirm the structural placement, overlapping and trying of steel rods extending vertically through a cell of the block and wherein the opening is bordered on opposite sides by edges which extend from a front fact of the block to an inner face of the cell comprising, a form means having side wall portions and a front face, said form means being of a size to be inserted within the cell of the block through the inspection opening and thereafter oriented to close the opening with said side wall portions thereof engaging the edges defining the opening in the block, a plurality of spaced holes through said front face, and retainer means for securing said form means within the opening.

2. The apparatus of claim 1 in which said retainer means includes a member having two end portions which extend outwardly into engagement with the front face of the block.

3. The apparatus of claim 1 in which said retainer means includes at least one clip means extending rearwardly relative to said front face and on opposite sides thereof, said clip means including outer ends for engaging the inner face of the cell.

4. The apparatus of claim 3 in which said holes are inclined downwardly from said front face of said form means.

5. The apparatus of claim 3 in which said side wall portions include flange members which are generally parallel to, but spaced from, said front face of said form means.

6. An apparatus for sealing an inspection opening formed in a concrete block which opening permits a visual inspection to be made to confirm the structural placement, overlapping and tying of steel rods extending vertically through a cell of the block and wherein the opening is bordered on opposite sides by edges which extend from a front face of the block to an inner face of the cell comprising, a form means having side wall portions and a front face, said form means being of a size to be inserted within the cell of the block through the inspection opening and thereafter oriented to close the opening with said side wall portions thereof engaging the edges defining the opening in the block, said side wall portions of said form means including at least two vertically oriented walls, said walls extending rearwardly of said front face and first flanges extending from said walls, said flanges being oriented generally parallel to but spaced from said front face of said form means and being engagable with the inner face of the block cell.

7. The apparatus of claim 6 including a top wall extending rearwardly of said front face, and a second flange extending upwardly from said top wall and generally parallel to but spaced from said front face of said form means.

8. The apparatus of claim 6 in which said form means is generally transparent.

9. The apparatus of claim 8 including retainer means for securing said form means within the opening.

10. The apparatus of claim 6 in which the thickness of the concrete block adjacent the opening between the inner face of the cell and the front face of the block is of a first dimension and wherein the distance between said first flanges and the front face of said form means is less than said first dimension whereby said front face of said form means is recessed with respect to the front face of the block when said form means is installed within the opening.

11. The apparatus of claim 10 in which said form means is generally transparent.

12. The apparatus of claim 10 in which said form means includes a plurality of spaced holes through said front face thereof.

13. The apparatus of claim 10 in which said form means includes front and rear sections, means for interfitting said front and rear sections in slidable relationship with respect to one another, and adjustment means for selectively extending said front and rear sections outwardly with respect to one another.

14. The apparatus of claim 13 in which said adjustment means includes an abutment wall mounted to said rear section, a cam member mounted adjacent said abutment wall, and means for selectively rotating said cam member against said abutment wall to thereby extend said rear section outwardly with respect to said first panel.

15. The apparatus of claim 13 in which said front and rear sections include a plurality of holes therethrough, and said adjustment means including guide means for extending said rear section horizontally with respect to said front section to thereby vary the width of said form means.

16. The apparatus of claim 13 in which said front and rear sections include a plurality of holes therethrough, and said adjustment means including guide means for extending said rear section upwardly with respect to said front section to thereby vary the height of said form means.

17. The apparatus of claim 1 in which said retainer means include a plurality of clip means which extend rearwardly relative to said front face of said form means, each of said clip means having an outer hooked end portion for selectively engaging the inner face of the block cell.

18. The apparatus of claim 1 including a plurality of clip means which extend rearwardly relative to said front face of said form means, each of said clip means having an outer hooked end portion which is selectively engageable with the edges defining the openings in the block.

19. A combination construction block and inspection window comprising, a concrete block having upper and lower edges and a wall having a front face and an inner face and at least one interior cell, an opening from said front face into said cell, said opening being bordered on either side by side edges which extend from said front face to the inner face of the wall, the distance between said front face and said inner face of said wall being defined by a first dimension, a form means having a front face and side walls extended rearwardly therefrom, said side walls of said form means being selectively engagable with said side edges adjacent said opening, and said form means having at least one air hole opening therethrough.

20. The combination concrete block and inspection window of claim 19 in which said form means is transparent.

21. The combination concrete block and inspection window of claim 20 wherein said form means includes a plurality of air holes through the front face thereof.

22. A combination construction block and inspection window comprising, a concrete block having upper and lower edges and a wall having a front face and an inner face and at least one interior cell, an opening from said front face into said cell, said opening being bordered on either side by side edges which extend from said front face to the inner face of the wall, the distance between said front face and said inner face of said wall being defined by a first dimension, a form means having a front face and side walls extended rearwardly therefrom, said side walls of said form means being selectively engagable with said side edges adjacent said opening, a pair of first flanges extending outwardly from said side walls and generally parallel to said front face of said form means, and said first flanges being engagable with said inner face of said wall when said form means is placed within said opening.

23. The combination concrete block and inspection window of claim 22 wherein said front face of said form means is recessed with respect to said front face of said block wall when said form means is placed within said opening.

24. The combination concrete block and inspection window of claim 23 in which said opening extends from said upper to said lower surfaces of said block, said form means including an upper wall, and a second flange extending upwardly from said upper wall and being generally parallel to but spaced from said front face of said form means.

25. A combination construction block and inspection window comprising, a concrete block having upper and lower edges and a wall having a front face and an inner face and at least one interior cell, an opening from said front face into said cell, said opening being bordered on either side by side edges which extend from said front face to the inner face of the wall, the distance between said front face and said inner face of said wall being defined by a first dimension, a form means having a front face and side walls extended rearwardly therefrom, said side walls of said form means being selectively engagable with said side edges adjacent said opening, said form means including front and rear sections, and means for adjustably mounting said front and rear sections together so that said front and rear sections may be extended outwardly with respect to one another to thereby adjust the size of said form means.

26. The combination concrete block and inspection window of claim 25 in which said form means includes a plurality of air holes through each of said front and rear sections.

* * * * *